United States Patent [19]

Gollnick et al.

[11] Patent Number: 4,651,809

[45] Date of Patent: Mar. 24, 1987

[54] REGENERATIVE HEAT EXCHANGER

[75] Inventors: Wilhelm Gollnick; Friedrich Klauke; Karl-Heinz Mohr, all of Katingen, Fed. Rep. of Germany

[73] Assignee: Balcke-Dürr Aktiengesellschaft, Ratingen, Fed. Rep. of Germany

[21] Appl. No.: 749,299

[22] Filed: Jun. 27, 1985

[30] Foreign Application Priority Data

Jun. 29, 1984 [DE] Fed. Rep. of Germany ..... 3423962

[51] Int. Cl.[4] ..... F28D 19/00

[52] U.S. Cl. ..... 165/9; 165/5

[58] Field of Search ..... 165/9, 5

[56] References Cited

U.S. PATENT DOCUMENTS

| | | | |
|---|---|---|---|
| 1,746,598 | 2/1930 | Ljungstrom | 165/9 |
| 3,800,859 | 4/1974 | Norback | 165/9 |
| 4,399,863 | 8/1983 | Banasiuk | 165/9 |

FOREIGN PATENT DOCUMENTS

| | | | |
|---|---|---|---|
| 250172 | 11/1925 | United Kingdom | 165/9 |
| 2119037 | 11/1983 | United Kingdom | 165/9 |

*Primary Examiner*—Albert W. Davis, Jr.
*Attorney, Agent, or Firm*—Becker & Becker, Inc.

[57] ABSTRACT

A regenerative heat exchanger having a heat-exchanging storage medium which is provided with a plurality of flow channels. At each end there is provided a respective hood, which divides the storage medium via radial sealing members into at least one portion which receives heat-emitting gases, and at least one portion which receives heat-absorbing gases, with said portions, as a result of a continual relative rotation between the storage medium and the hood, alternately receiving the two types of gases. Sealing members are also disposed along the periphery between the hoods and a housing which accommodates the storage medium. In order to simplify the construction, reduce the amount of space required, and to improve the efficiency and avoid periodic down times for cleaning and in particular the leading edges of the storage medium, the radial sealing members are embodied as sealing strips which rest yieldingly directly against the respective planar end face of the storage medium. The yielding engagement can be achieved either by special spring elements, or by the inherent elasticity of the sealing strips. The actual sealing element can be a plurality of bristles which are held in a support body and are enclosed along the longitudinal edges of the sealing strips by sealing arms which are embodied as gap seals.

1 Claim, 3 Drawing Figures

REGENERATIVE HEAT EXCHANGER

BACKGROUND OF THE INVENTION

1. Field of the Invention

The present invention relates to a regenerative heat exchanger having a heat-exchanging storage medium which is provided with a plurality of flow channels; at each end there is provided a respective hood, which divides the storage medium by means of radial sealing means into at least one portion which receives heat-emitting gases, and at least one portion which receives heat-absorbing gases, with these portions, as a result of a continual relative rotation between the storage medium and the hood, alternately receiving the two types of gases; sealing means are also disposed along the periphery between the hood and a housing which accommodates the storage medium.

2. Description of the Prior Art

Regenerative heat exchangers of the aforementioned general type are known, with the relative movement between the storage medium and the hood being generated by a rotary drive of either the storage medium or of the hood.

With the heretofore known regenerative heat exchangers, the storage medium is divided into individual sectors with the aid of radial partitions. These radial partitions extend beyond the respective end faces of the storage medium, and their edges cooperate with the radial sealing means which divide the storage medium into at least one portion which receives heat-emitting gases and at least one portion which receives heat-absorbing gases. The sealing means which seal the periphery of the storage medium relative to the hood are also spaced somewhat from the respective end face of the storage medium; these sealing means cooperate with a structure which is provided on a housing accommodating the storage medium.

In order to ensure the sealing effect of the radial sealing means, which sealing effect is necessary during a relative movement between the storage medium and the hood, these radial sealing means have a width which corresponds at least to the width of the respective sector, so that between the flow of the heat-emitting gas and the heat-absorbing gas there is always one sector in the storage medium which does not receive gas.

Not only do these heretofore known embodiments of regenerative heat exchangers have the drawback of having a large structural height as a result of the partitions and housing structures which extend beyond the storage medium, but they also require a complicated and expensive configuration of the support body and of the housing for the storage medium, because these parts must be relied upon for the sealing effect. Finally, the sealing means themselves also have a complicated and expensive construction, so that the flow for the two gases is unfavorably affected. A further critical drawback is that the heat-exchanging heating surfaces of the storage medium must be cleaned with cleaning or rinsing fluid from time to time because especially the leading edges of the flow channels embodied in the storage medium become dirty or even clogged. When such clogging occurs, it can normally no longer be eliminated by cleaning fluid, so that it is necessary to stop the regenerative heat exchanger and mechanically clean the leading edges.

An object of the present invention is to improve a regenerative exchanger of the aforementioned general type in such a way that together with simplification of the construction and reduction of the space required, it is no longer necessary to periodically mechanically clean the leading edges of the storage medium.

BREIF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
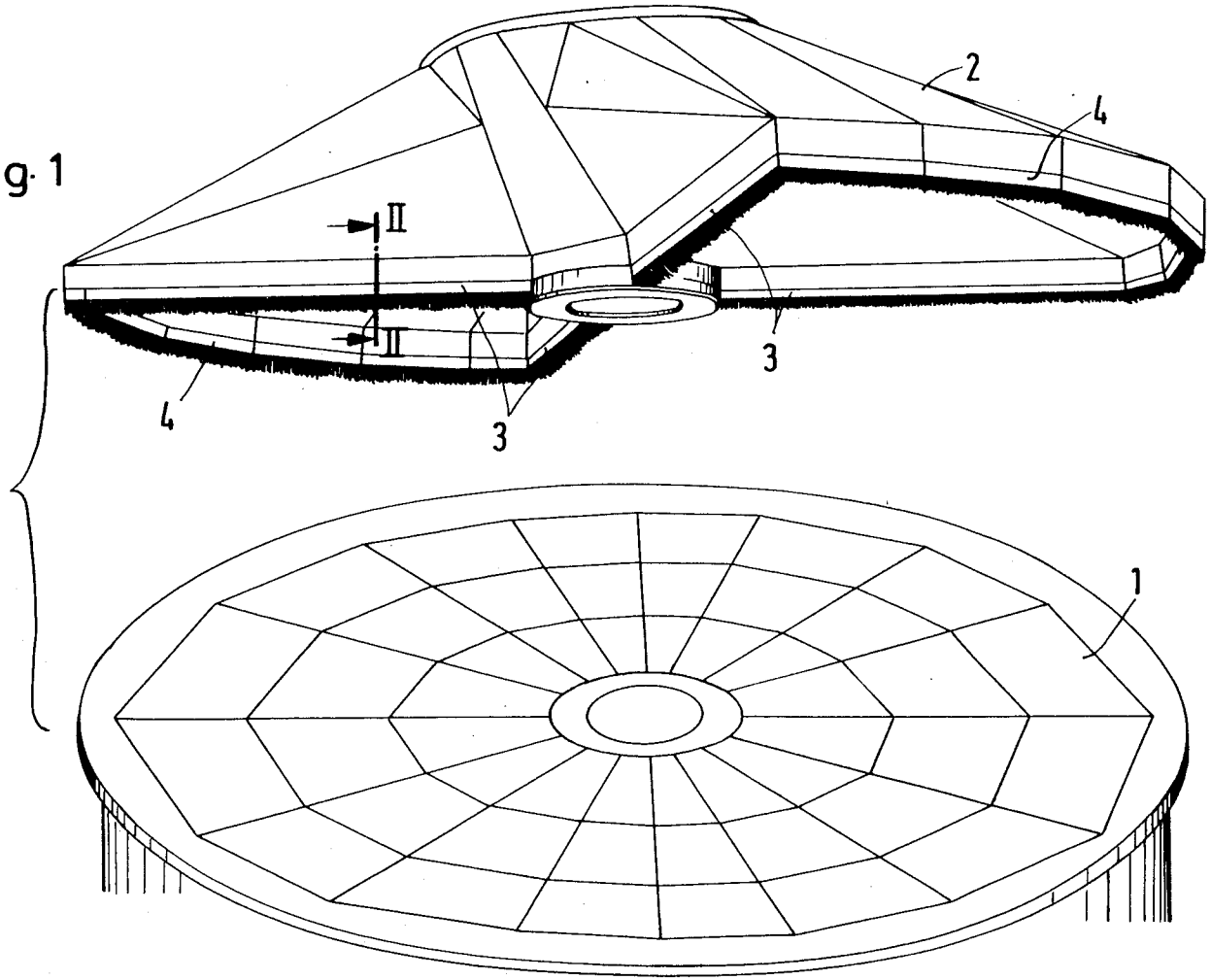
FIG. 1 is a partially exploded view showing the storage medium and a hood of one inventive embodiment of a regenerative heat exchanger, the rest of which is not illustrated.

The regenerative heat exchanger of the present invention is characterized primarily in that the radial sealing means are embodied as sealing strips which rest yieldingly directly against the respective planar end face of the storage medium.

As a result of the direct engagement of the sealing strips against the planar end faces of the storage medium, not only is the heretofore existing expensive and complicated construction for the sealing means avoided, but the structural height of the regenerative heat exchanger is also reduced by that amount which resulted from the projecting radial partitions and the complicated housing structure which were provided for achieving a sealing effect. The inventive sealing strips, which rest yieldingly against the storage medium, are structurally much simpler, can be more easily replaced, and result in the great advantage that during the continuous relative movement between the storage medium and the hoods, these sealing strips continually effect a mechanical cleaning of the leading edges of the storage medium, so that the previously required down times for mechanically cleaning the storage medium are eliminated. As a result of the direct cooperation of the sealing strips with the respective planar end face of the storage medium, not only is a better sealing effect achieved, but a negative influencing of the flows of the two gases is also avoided. Thus, the structural simplification achieved with the present invention results not only in advantages during manufacture and maintenance of the regenerative heat exchanger, but also in an improvement of the efficiency and performance.

Pursuant to a further feature of the present invention, the sealing strips can be provided with a sealing element which is softer than the material of the storage medium, and which can be pressed against the storage medium by spring force. Pursuant to an alternative embodiment of the invention, the sealing strips can be provided with an inherently elastic sealing element which rests directly against the storage medium. Thus, the yielding pressing of the inventive sealing strips against the planar end faces of the storage medium can be achieved either by utilizing elastic material properties, or by using springs. In addition to spring elements proper, pneumatic, gas, or even hydraulic spring means can be utilized.

Pursuant to a preferred embodiment of the present invention, the actual sealing element is formed by a plurality of bristles which are held in a support body, and which are enclosed along the longitudinal edges of the sealing strips by sealing arms which are embodied as gap seals. This inventive embodiment results in a highly elastic construction for the sealing means and for the cleaning, which furthermore conforms to the unevenness of the end faces of the storage medium without damaging the latter. If, pursuant to a further feature of the present invention, the sealing arms comprise a material which is softer than the material of the storage medium, these sealing arms can be disposed relatively close to the end face of the storage medium, again without damaging the latter, so that there results a considerable improvement over the heretofore existing metallic sealing means, while at the same time avoiding all wear of the remaining parts. The bristles held in the support body, and possibly also the sealing arms, can be replaced in a simple manner and present a negligible obstruction for the flow of the two heat-exchanging gases.

The inventive embodiment can be utilized for many applications, especially on regenerative heat exchangers for heating up the scrubbed gases downstream of desulfurization units, for preheating air, and in general with regenerative heat exchangers where the leading edges of the storage medium become extremely dirty.

DESCRIPTION OF PREFERRED EMBODIMENTS

Referring now to the drawings in detail, with the exemplary embodiment of a regenerative heat exchanger schematically illustrated in FIG. 1, the storage medium 1, which is provided with a plurality of flow channels, remains still, whereas the hood 2 is rotated; to facilitate understanding, the hood 2 is illustrated at a distance from the associated planar end face of the storage medium 1. It should be understood that it is also possible to have the hood 2 be stationary while the storage medium 1 is rotated.

In order to achieve a sealing effect between the storage medium 1 and the hood 2, and in order to continually divide the storage medium 1 during the relative rotational movement into at least one portion which receives heat-emitting gases, and at least one portion which receives heat-absorbing gases, the hood 2 is provided with radially extending sealing strips 3. In the illustrated embodiments, four sealing strips 3 are provided, each of which extends over the length of the radius. These sealing strips 3 are disposed in the manner of a cross or X, and form two channels which are disposed on opposite sides of the center of rotation, with one of the channels being for heat-emitting gas, and the other channel being for heat-absorbing gas. The two essentially circular arcs present along the periphery of the hood 2 between the two sets of radially extending sealing strips 3 are similarly provided with sealing strips 4, which in the illustrated embodiment are each composed of individual sections.

Figure 2:
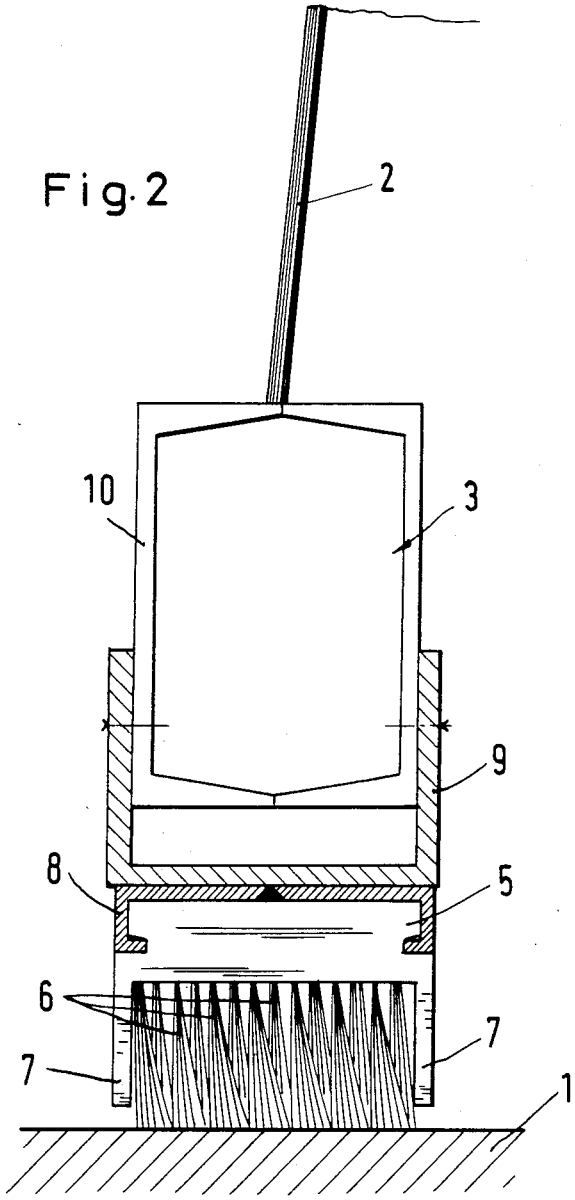
FIG. 2 is a partial sectional view through a radial sealing means of the hood and is taken along the line II—II in FIG. 1.

As illustrated in the partial sectional view of FIG. 2, the radially extending sealing strips 3 rest directly and yieldingly against the respective planar end face of the storage medium 1. In the embodiment of FIG. 2, the sealing strips 3 have an inherently elastic sealing element which is formed by a plurality of bristles 6 which are held in a support body 5. These bristles 6 are inclosed along the longitudinal edges of the sealing strips 3 by sealing arms 7 (of the support body 5) which are embodied as gap seals. These sealing arms 7 preferably comprise a material which is softer than the material of the storage medium 1, so that those edges of the arms 7 which face the storage medium 1 can be disposed relatively close to the storage medium 1. As a result via the sealing arms 7, there is already achieved a good sealing effect which is supplemented by the bristles 6. As the hood 2 rotates relative to the storage medium 1, these bristles 6 finally assure that the leading edges of the storage medium 1 are continually kept mechanically clean.

In the embodiment of FIG. 2, the sealing arms 7 are disposed on a profiled supporting member 8 together with the support body 5 and the bristles 6. This profiled supporting member 8 is disposed on a profiled connecting member 9, which in turn is attached to a profiled chamber member 10 of the hood 2 formed of two U-shaped sections.

Figure 3:
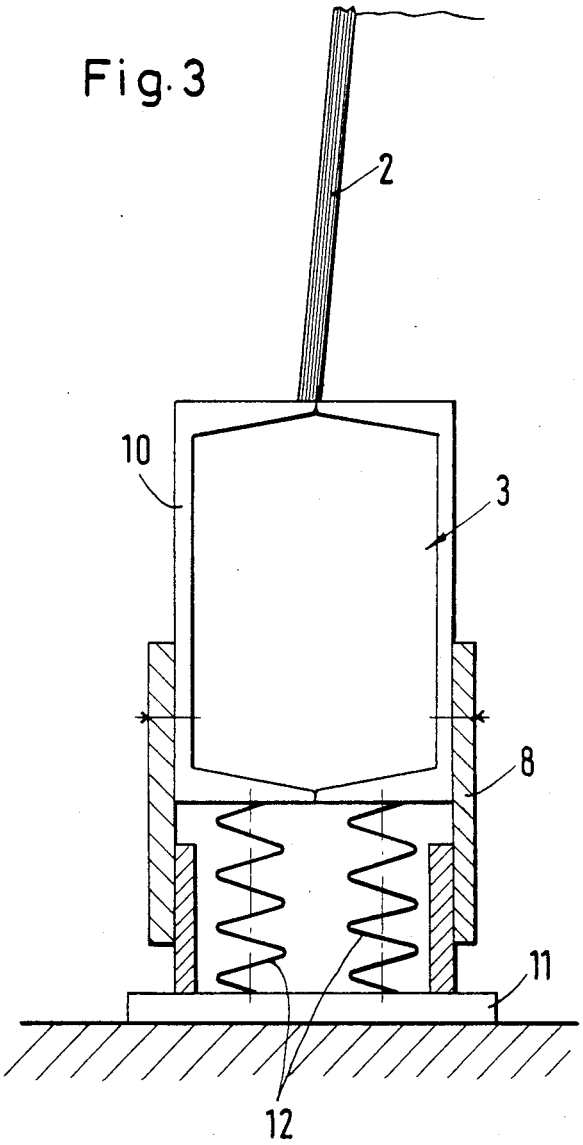
FIG. 3 is a partial sectioned view through a radial sealing means of the hood, and shows an alternative embodiment of the sealing strip.

In the alternative embodiment of FIG. 3, the actual sealing element 11 of the sealing strip 3 is made of a material which is softer than the material of the storage medium 1; the sealing element 11 has no inherent elasticity. With this embodiment, the yielding pressing effect is achieved by springs 12 which are disposed between the sealing element 11 and the profiled supporting member 8 or chamber member 10.

As can be seen in FIG. 1, in the illustrated embodiment the sealing strips 4, which are disposed along the periphery of the hood 2, are also embodied in the manner described in connection with FIG. 2. Naturally, it is also possible to have the sealing strips 3 and the sealing strips 4 differ from one another, since it is exclusively the sealing strips 3 which, in addition to their sealing function, have to produce a cleaning effect.

The present invention is, of course, in no way restricted to the specific disclosure of the specification and drawings, but also encompasses any modifications within the scope of the appended claims.

What we claim is:

1. A regenerative heat exchanger having a heat-exchanging storage medium which has leading edges as well as substantially planar end faces and is provided with a plurality of flow channels; at each end there is provided a respective hood, which divides said storage medium by means of radial first sealing means into at least one portion which receives heat-emitting gases, and at least one portion which receives heat-absorbing gases, with said portions, as a result of a continual relative rotation between said storage medium and said hoods, alternately receiving said two types of gases; second sealing means are disposed along the periphery between said hoods and a housing which accommodates said storage medium; comprising the improvement therewith wherein:

said radial first sealing means includes sealing strips which rest yieldingly directly against the respective planar end face of said storage medium, via said sealing strips which rest yieldingly directly against the storage medium there being attained a mechanical cleaning of leading edges of the storage medium because of continuous relative movement between said storage medium and the respective hoods so that previously necessary standstill time for mechanical cleaning of the storage medium is eliminated, via direct cooperation of said sealing strips with said planar end faces of said storage medium there being attained not only a better sealing effect but also there is avoided any negative influencing of flow of said heat-emitting gases and said heat-absorbing gases;

each of said sealing strips being provided with an inherently elastic sealing element which rests directly against said storage medium;

said sealing element being in the form of a plurality of bristles; and each of said sealing strips including a support body for holding said bristles, and, along longitudinal edges of said sealing strips, sealing arms which are embodied as gap seals and enclose said bristles;

said sealing arms being made of a material which is softer than the material of said storage medium.

* * * * *